US007785161B2

(12) United States Patent
Wilkinson

(10) Patent No.: US 7,785,161 B2
(45) Date of Patent: Aug. 31, 2010

(54) VEHICLE

(76) Inventor: Stuart Leslie Wilkinson, 833 Calder Rd., Mississauga, Ontario (CA) L5J 2N6

( * ) Notice: Subject to any disclaimer, the term of this patent is extended or adjusted under 35 U.S.C. 154(b) by 0 days.

(21) Appl. No.: 12/044,938

(22) Filed: Mar. 8, 2008

(65) Prior Publication Data

US 2009/0227156 A1 Sep. 10, 2009

(51) Int. Cl.
*B63H 16/00* (2006.01)

(52) U.S. Cl. ..... 440/21; 441/76

(58) Field of Classification Search ..... 440/17, 440/21, 24, 25, 26, 20; 441/74, 76
See application file for complete search history.

(56) References Cited

U.S. PATENT DOCUMENTS 5,194,023 A * 3/1993 Stone ..... 440/20
5,445,549 A * 8/1995 Lekhtman ..... 440/17
5,702,274 A * 12/1997 White ..... 440/21

* cited by examiner

*Primary Examiner*—Lars A Olson

(57) ABSTRACT

A vehicle for movement relative to a medium, the vehicle comprising a base, and a carriage mounted on the base for supporting a human operator, the carriage mounted for forward and rearward movement relative to the base upon being driven by bipedal movement of the operator, a thrust mechanism operable to develop vehicle thrust by transmitting a force to the medium upon bipedally driven rearward movement of the carriage and a force mechanism operable to apply a force to the base upon bipedally driven forward movement of the carriage.

6 Claims, 11 Drawing Sheets

VEHICLE

TECHNICAL FIELD OF THE INVENTION

This invention relates to a vehicle.

DESCRIPTION OF RELATED ART

Reflecting on Jesus Christ's reported sojourn at the Sea of Galilee and the valedictory sight of Chancy Gardener in the movie, Being There, who has not wished to walk on water? And, indeed, walking on water has captured the imagination of many people for there have been many proposals for water walkers. These have generally been analogous to cross-country snow skis. They have two floats and the walker places a foot into a compartment in respective floats. The floats are then operated in a manner similar to snow skis in which one float of each pair becomes the thrust float while the other float is the leverage float. Subsequently, the leverage float is brought forward to become the thrust float while the erstwhile thrust float becomes the leverage float. To assist in gaining forward motion, there is normally deployed at each float some form of flap or a structure having an equivalent function. The flap is pivoted to a horizontal position to reduce drag during forward motion of the thrust float and is pivoted to a vertical position to increase drag at the leverage float. By using separate floats where, at any time, there is one thrust float and one leverage float, it is difficult to sustain momentum because the forward motion of the thrust float has effectively to be halted in order for it to function as a leverage float. In addition, the two floats in combination must support the weight of a person and so must displace a volume of water equal to the weight of the person. This means that at each forward thrust of a float from essentially a standing position, a significant quantity of water must be displaced. Consequently, it is difficult to obtain any significant momentum and the Sisyphean demands of such a water walker on its captain probably accounts for the fact that such water walkers are rarely seen beyond the patent annals.

SUMMARY OF THE INVENTION

According to one aspect of the invention, there is provided a vehicle for movement relative to a medium, the vehicle comprising a base, and a carriage mounted relative to the base for supporting a human operator, the carriage mounted for forward and rearward movement relative to the base upon being driven by bipedal movement of the operator, a thrust mechanism operable to develop vehicle thrust by transmitting a force to the medium upon bipedally driven rearward movement of the carriage, and a drive mechanism operable to apply a drive to the base upon bipedally driven forward movement of the carriage.

Preferably, the vehicle has two such carriages, mounted side by side relative to the base, for supporting respective feet of the operator.

Preferably the thrust mechanism includes at least one element movable between a deployed position enabling application of force from the carriage to the medium upon the rearward movement of the carriage, and a neutral position, disabling application of force from the carriage to the medium. Particularly for moving through water, the element in the deployed position presents a high drag form to the water and presents in the neutral position a low drag form to the water. For example, the element can be in the form of a blade either pivotable or reciprocable between the deployed and neutral positions. Particularly for moving over a solid medium, the element in the deployed position presents a high friction contact with the medium and presents in the neutral position either a low friction contact with the medium or is removed from contact with the medium.

Preferably the thrust and drive mechanisms are located so that the thrust is developed below the base and the force is applied to the base above the base.

The vehicle preferably includes first control mechanisms for relating timing of application of the drive and development of the thrust. The vehicle can also include second control mechanisms for relating duration of application of the drive and development of the thrust to movement of the carriage. The vehicle can also include third control mechanisms for controlling magnitude of the drive and thrust. The vehicle can also include a fourth control mechanism operable to adapt movement of the element to the relative velocity of the base relative to the medium.

Particularly for a vehicle movable over water, the base can be formed as or integral with a flotation hull. Particularly for a vehicle movable over snow or ice, the base can be formed with a lower surface adapted for sliding. Particularly for a vehicle movable over the ground, the base can be mounted on or formed as a part of a wheeled chassis.

According to another aspect of the invention, the carriages can be mounted to the base to permit upward movement of a carriage during forward movement of the carriage relative to the base, and to permit downward movement of the carriage during rearward movement of the carriage relative to the base. In such an embodiment, some part of the bipedal drive to the carriages is converted to a lifting force to lift the carriages.

According to another aspect of the invention, there is provided an assembly for use in a vehicle for movement relative to a medium, the assembly comprising a base, a carriage mounted on the base for supporting a standing human operator, the carriage mounted for forward and rearward movement relative to the base, a thrust mechanism operable to develop vehicle thrust by transmitting a force to the medium upon rearward movement of the carriage and a force mechanism operable to apply a force to the base upon bipedally driven forward movement of a carriage.

According to another aspect of the invention, there is provided a carriage for use in a vehicle drivable relative to a medium, the carriage having a mounting means for mounting the carriage in a vehicle base for reciprocal movement of the carriage in the base in a drive direction and a reverse direction, a drive mechanism deployable to use movement of the carriage in the drive direction to apply a drive to the base and a thrust mechanism deployable to use movement of the carriage in the reverse direction to develop the thrust.

According to another aspect of the invention, there is provided a carriage for use in a vehicle drivable relative to a medium, the carriage having a bearing for mounting the carriage relative to a vehicle base to permit reciprocal movement of the carriage in a drive direction and a reverse direction, the bearing having a free bearing action in relation to the carriage moving relative to the vehicle base in the reverse direction and having a non-free bearing action in relation to the carriage moving relative to the vehicle base in the drive direction.

According to another aspect of the invention, there is provided an assembly for use in a vehicle for movement relative to a medium, the assembly comprising a base, and a pair of carriages reciprocally movable relative to the base in a drive direction and a reverse direction, the carriages each having a surface for supporting a standing human operator and being spaced apart transverse of the drive direction to accommodate respective feet of an operator standing on the carriages and facing in the drive direction.

A vehicle according to one aspect of the invention can be designed as a personal use vehicle. Alternatively, a vehicle according to another aspect of the invention can accommodate a number of operators with stations distributed over the vehicle base to accommodate respective operators. In such a multi-operator vehicle, elements of the drive mechanism and the thrust mechanism can be shared or ganged. To tailor operation to operators of different size, strength and gait, some of the vehicle elements can be made adjustable so that at least some of the dimensions and specifications can be changed to fit the instant operator.

According to another aspect of the invention, a vehicle as described previously has poles in the manner of ski poles mounted on the vehicle base to be gripped by the vehicle operator. The mounting is preferably such that the natural swinging action of a running or walking operator is harnessed and is applied through a transfer mechanism to the thrust mechanism to supplement the development of thrust or is applied through a transfer mechanism to the drive mechanism to supplement the application of the drive to the base.

According to another aspect of the invention, a vehicle described previously has a respective hammer member coupled to the carriage through a respective flexible coupling permitting hammer member oscillation in the drive direction of the vehicle. Preferably, upon operator bipedal movement, the coupling is such that a natural oscillation is set up in the movement of the hammer member relative to the base. The hammer member can be coupled to the thrust and/or drive mechanisms so that part of the kinetic energy in the hammer member oscillation is tapped and is used in developing the thrust and/or drive applied to the base. Preferably, the flexible coupling is such that part of the energy expended in the operator's bipedal movement is used in maintaining the oscillation.

According to another aspect of the invention, for a vehicle previously described for use on water, there is provided a trim mechanism to alter buoyancy of the vehicle whereby essentially all elements of the vehicle apart from the operator are submersed in the water, thereby presenting the desirable spectacle of the operator walking on water.

BRIEF DESCRIPTION OF THE DRAWINGS

It be appreciated that for simplicity and clarity of illustration, elements illustrated in the following FIGs. have not necessarily been drawn to scale. For example, the dimensions of some of the elements are exaggerated relative to other elements for clarity. Other advantages, features and characteristics of the present disclosure, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF PREFERRED EMBODIMENTS OF THE INVENTION

Figure 1:
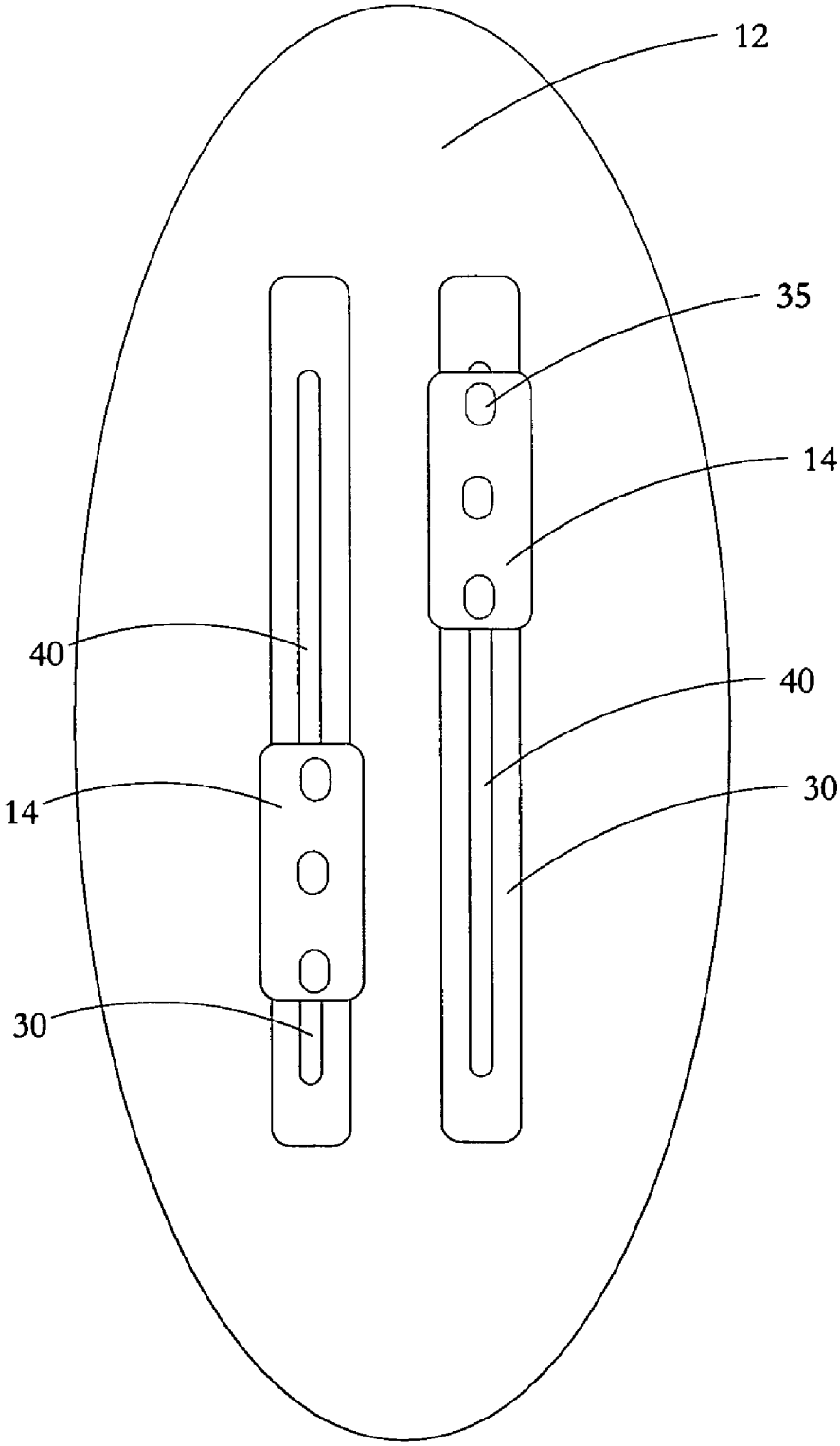
FIG. 1 is a plan view of a vehicle according to an embodiment of the invention, the vehicle for conveying a person on water.
Figure 2:
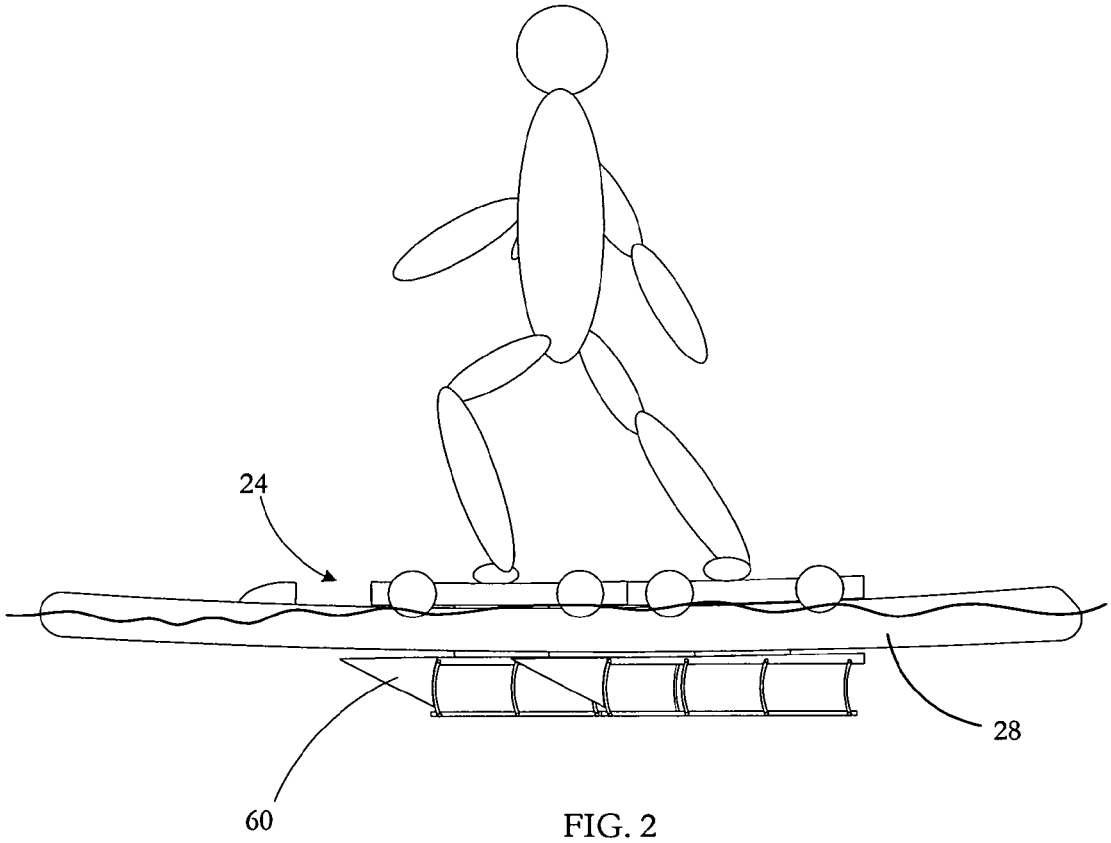
FIG. 2 is a side view of the vehicle of FIG. 1 showing the operator in full stride.

Referring to FIG. 1, a vehicle is illustrated which is adapted to be manually propelled on or through water by a bipedal action of an operator, such as by walking or running. The vehicle has a base 12 supporting left and right carriages 14. Each of the carriages has a surface 18 and as shown in FIG. 2, a vehicle operator 20 stands with left foot supported by the surface of the left carriage and right foot supported by the surface of the right carriage. The carriages are supported on the base 12 to support the weight of the operator 20 and to enable the carriages to be driven backwards and forwards by bipedal movement of the operator. The vehicle 10 includes a thrust mechanism shown generally at 22 operable to generate thrust by applying a force to the water upon rearward movement of one of the carriages 14 relative to the base 12, and a drive mechanism shown generally at 24 by means of which the operator converts the thrust into a drive applied through the other carriage to the base 12 upon forward movement of the other carriage relative to the base. The use of the term "carriage" in this specification is not intended to imply any limitation other than it should be a body which has a supporting surface for an operator's foot and is mounted relative to the base 12 to permit reciprocal movement relative to the base 12 in a drive and reverse direction.

In operation, the vehicle operator, whose name is Fortibus, stands facing in the drive direction with left foot supported on the left carriage and right foot supported on the right carriage, and thrusts, say, the right foot backwards to move the right carriage backwards relative to the base 12 until a rearward stride terminates. During the rearward motion of the right carriage, the operator applies force via the thrust mechanism to the water thereby creating thrust which is transmitted back through the right carriage, the operator, and the left carriage, and as described below, is converted to a drive force applied to the base. While the right foot undergoes a rearward stride, the operator's left foot undergoes a forward stride. During the forward movement of the left carriage, the operator applies drive applied to the base 12 by means of the drive mechanism 24. Provided the drive force is greater than all rearward forces applied to the vehicle, the vehicle moves forward relative to the water.

The drive force applied during one stride, being a forward movement of one carriage and rearward movement of the other carriage, is small, because it is limited by the energy expended by the operator in a single scissors stride. However, through continuous bipedal movement of the left and right leg in the manner of a person walking, running or cross-country skiing, cumulative forwardly directed drive forces on the vehicle exceed cumulative rearwardly directed forces, and the vehicle velocity increases. "Bipedal" is understood, for the purposes of this specification, to mean a scissors-type motion of the operator's legs because, over the long term, the carriages themselves do not move relative to the base.

The thrust developed by the thrust mechanism arising from rearward movement of one carriage is used for two purposes. Part of the thrust is used to drive the other carriage forward to complete a forward stride and restore the carriage to a start position, while the remaining part of the thrust is applied to the base by the drive mechanism.

Referring in greater detail to FIGS. 3 to 6, the operator's foot is retained at the surface 18 by friction engagement, although alternative arrangements can be used such as a protuberance on the sole of operator footwear engaging with a housing on the carriage, or such as a toe clip or stirrup of the sort commonly used on cycle pedals. Alternatively, the carriage can be formed as the lower part of footwear, such as a boot. The base 12 is mounted on or is an integral part of a hull 28. Suitable materials for the hull include those used in windsurfers, such as an expanded polystyrene foam core reinforced with a shell of composite materials such as carbon fiber or fiberglass set in an epoxy matrix. Other more traditional materials and structures such as a hollow marine plywood hull are also possible.

Figure 7:
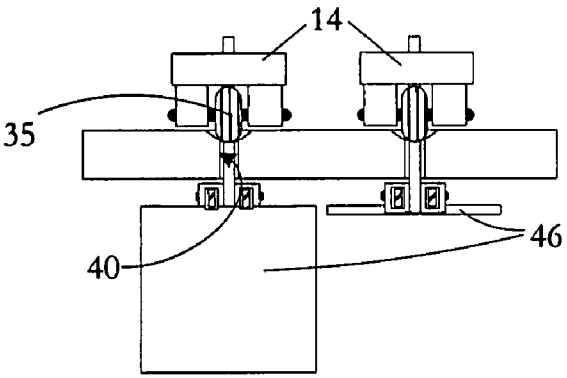
FIG. 7 is a front view of a pair of carriages and associated blade arrangements according to one embodiment of the invention.

Each of the carriages runs on a respective track 30 extending along the base 12 in a drive direction of the vehicle. As shown in the example of FIG. 7, the carriages 14 each have an undercarriage 32 similar to the undercarriage of an in-line skate, and the tracks 30 are in this example simply a pair of laterally spaced channeled parts of the upper surface of the base 12. Each undercarriage 32 has wheels 35 running in the track 30 and supported by the upper surface of the base 12. In use, the wheels of each carriage 14 tend to locate in a corresponding one of the channeled parts as the carriages are reciprocated backwards and forwards in a bipedal movement.

In an alternative embodiment, the undercarriage can resemble a dry skate (not shown) supported on a base of hard-wearing silicone of the sort used in artificial surface skating rinks. In a further alternative, a more complex and constraining supporting arrangement may be used to guide the carriages. In one example, this takes the form of rails formed on the base, each rail having a bearing interaction with an appropriately formed part of one of the carriages. Alternatively, a follower depends from each carriage and is disposed to run in a channel formed in the base. The bearings can be of rotary or other suitable form.

In the embodiment of FIGS. 1 and 2, the drive mechanism 24 can be viewed as having two components which together apply the drive force. The first component is the carriage 14 itself and the operator's control of it. Thus, the bipedal movement periodically involves the forward movement of the carriage 14 being halted by the operator's control of his or her leg movements followed by the carriage being rearwardly accelerated. The effect of these two motions is to transfer part of the operator's and the carriage's forward momentum through the wheels 35 and via the base to the hull.

Figure 4:
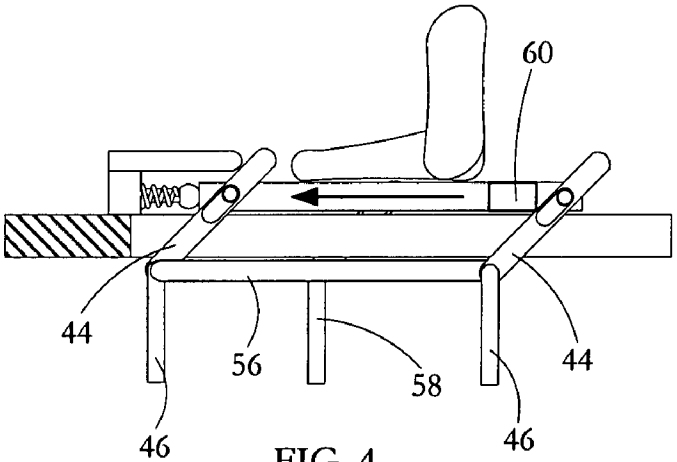
FIG. 4 is a view corresponding to the view of FIG. 3, but showing the carriage in a second position.
Figure 6:
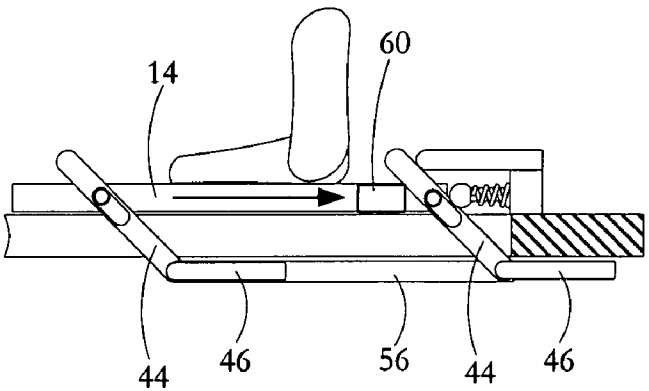
FIG. 6 is a view corresponding to the view of FIG. 3, but showing the carriage in a fourth position.
Figure 3:
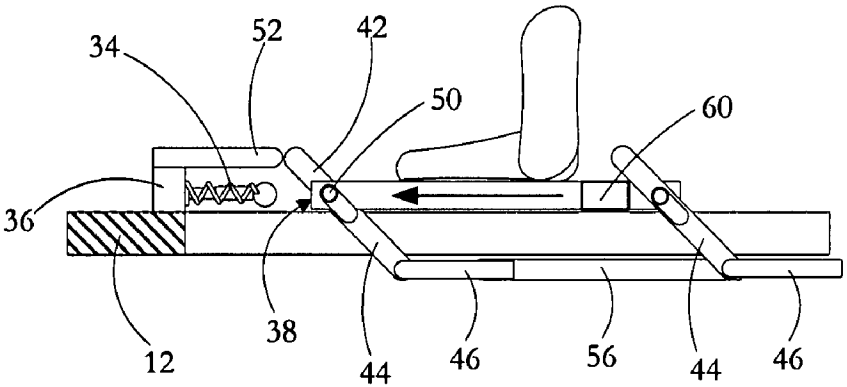
FIG. 3 is a part-sectional side view of a part of the vehicle of FIG. 1 showing a carriage in a first position.
Figure 5:
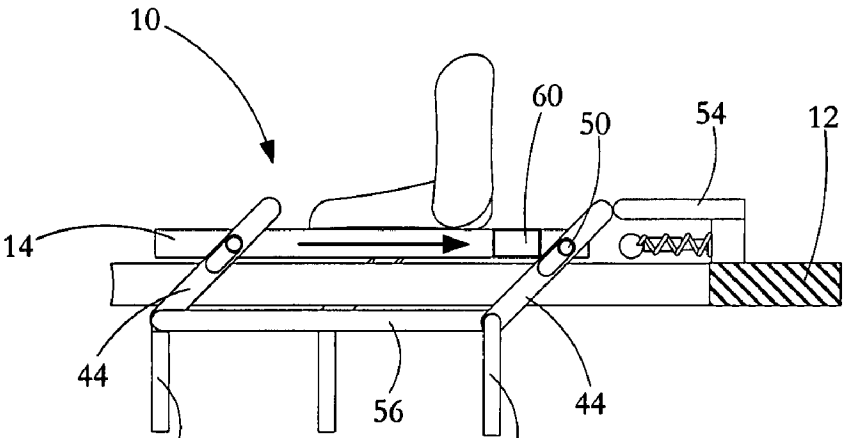
FIG. 5 is a view corresponding to the view of FIG. 3, but showing the carriage in a third position.

As shown in FIGS. 3 and 4, a second component includes an assembly having a buffer spring 34 mounted to an abutment member 36 integral with the base 12. This assembly is positioned to intercept and to halt forward motion of the carriage 14 near the limit of the operator's forward stride movement. The carriage 14 has an abutment face 38 at its front end at the same height and fore-aft line as the abutment member 36. As the carriage 14 impacts the spring 34, the spring is compressed and, in the process, some of the kinetic energy of the forwardly moving carriage is converted to potential energy in the compressed spring with the remaining kinetic energy being transmitted through duration and magnitude the spring 34 and abutment member 36 to the hull 28. Subsequently, the stored energy of the spring is released to initiate reverse movement of the carriage 14, the reverse movement of the carriage being continued by a reverse part of the bipedal drive applied by the operator 26. In the process of the forwardly moving carriage being brought to a halt and then accelerated rearwardly, the forwardly directed drive force is developed and applied through the base 12 to the hull 28. By appropriate design and positioning of the spring and abutment arrangement, the timing of the drive and its duration and magnitude can be related to the carriage's forward movement.

In an alternative embodiment of the secondary component, the undercarriage has wheels 35 which are a modified form of conventional in-line skate wheels. By the modification, the associated wheel bearings present minimal resistance to backward rolling movement of the carriage 14 along the base 12, but present resistance to turning during forward movement of the carriage along the base. Such a function can be implemented using an adaptation of known coaster brake mechanisms such as that described in U.S. Pat. No. 3,252,551 (Hood) which is incorporated herein by reference. The wheels 35 and the surface of the track 30 have non-slip contacting surfaces. When the wheel bearings tighten, a frictional force is developed and applied by the operator's forwardly moving foot through the carriage to the base. Either one or more of the carriage wheels can be of the turning-resistant type. In addition, the turning resistance can be introduced during only part of the forward movement of the carriage, such as the final part of a forward stride, as opposed to the full forward movement of the stride. Also, the turning resistance can be made adjustable depending on the power that the vehicle operator is to expend in developing thrust and applying the drive to the base. Also, the resistance to turning can be made intermittent, in the manner of an anti-lock braking system, and in which the turning resistance is applied until the wheel locks and the carriage begins to slide at which point the turning resistance is momentarily removed and then reapplied once the wheel starts to turn again. In an alternative embodiment, contact between the forwardly moving carriage and the base, whether as a constantly or intermittently applied force, can be applied between a part of the carriage other than the wheels and a part of the base other than the track. These various modifications can be tuned to obtain a desired timing, duration and magnitude of the drive applied to the base kin dependence on the carriage's forward movement.

In addition to the prior arrangements for applying the drive force to the base during forward movement of the carriages, other arrangements can be used adapted to the form and construction methods of the carriages and the base, and both simple and complex arrangements are contemplated by the invention.

As previously indicated, the vehicle includes thrust mechanism 22 by which the operator applies a rearwardly directed force to the water consequent upon rearward movement of the carriage 14 and thereby develops the forward drive to the vehicle. The thrust mechanism includes a central slot 40 extending the full height of the base 12 and located at the channeled track 30 under carriage wheels 42. As shown in FIG. 7, the slot 40 is narrower than the width of the wheels 35 so as not to prevent effective back and forth motion of the wheels in the track. The slot accommodates wings 42 of a pair of crank members 44 pivotally mounted respectively at the front and rear of the carriage. Another wing of each crank member is formed as a transversely extending blade 46. The crank members 44 move back and forth with the back and forth movement of the associated carriage 14. Additionally, each crank member is pivotable between the position shown in FIGS. 3 and 6, where the blades 46 are in a generally horizontal, neutral position, and the position shown in FIGS. 4 and 5, where the blades are in a vertical, deployed position.

Figure 9:
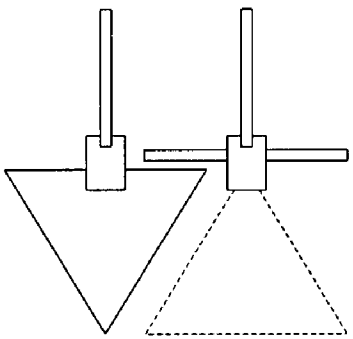
FIG. 9 is a front view of a further alternative form of blades according to another embodiment of the invention.
Figure 8:
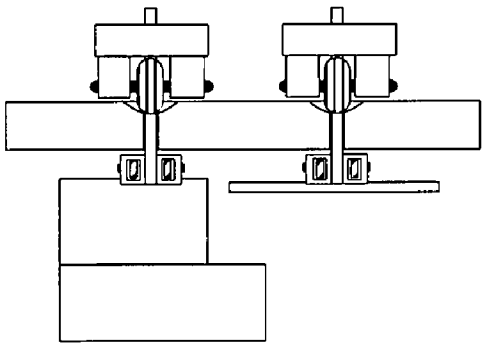
FIG. 8 is a view corresponding to the view of FIG. 7 but showing an alternative form of blades.

As the carriage is driven forward, the leading crank member 44 is forced to pivot from the neutral position to the deployed position as shown in the FIG. 3 to FIG. 4 sequence when a part of the wing 42 above pivot point 50 contacts extension 52 of the abutment member 36. Further movement of the carriage to the extreme forward position results in the crank member being pivoted to the FIG. 4 position. Subsequently, the carriage is driven rearwardly by the operator's rearward stride. During this phase, the blades 46 are in their vertical position and so force water backwards with the water's inertia developing a reactive force against the face of the blades. Near the limit of the carriage's rearward movement, the trailing crank member 44 is forced to pivot from the blade deployed position to the blade neutral position as shown in the FIG. 5 to FIG. 6 sequence when a part of the wing 42 of the trailing crank member 44 above pivot point 50 comes into contact with a projection 54 extending from the base 12. Further movement of the carriage to the extreme rearward position results in the crank being pivoted to the FIG. 6 position. Subsequently, the carriage is driven forwardly by the operator's forward stride. During this phase, the blades are in the horizontal, neutral position offering low resistance to carriage movement. A bar 56 links the two crank members 44 so that when one of them is pivoted by its engagement with one of the extension 52 or projection 54, as applicable, the other crank member moves in unison. As shown, additional blades 58 can be mounted to the bar 56 to be moveable between the neutral and deployed positions in concert with the blades 46. A suitable relay mechanism linking the additional blades to one or other of the crank members 44 ensures the additional blades move between neutral and deployed positions at appropriate phases of the carriage movement. The additional blades can be situated between the crank members 44 or can be mounted on extensions of the bar 56 projecting in front of or behind the associated carriage 14. As a carriage is driven rearwardly by the operator, a significant reactive force is applied against each blade surface so the blade structure, materials and mounting to the bar 56 and wing 42 are made sufficiently strong to resist damage from this force. A limiter 60 on the carriage prevents "overshoot" of the crank members 44 and their associated blades past the deployed position shown in FIG. 2 Such a limiter is not required in relation to forward movement of the carriage because the blades 46 are driven to stay in the neutral position by the forward passage of the hull and the associated blades through the water. However, to minimize drag effects, the blades may be retained by a detent applied immediately after the crank members 44 pivot to the blade neutral position, the detent being released by the subsequent engagement of the leading crank member with the extension 52. As shown in FIG. 7, the blades 46 are generally rectangular in form and are located with their centres vertically aligned with the centres of the carriages 14. To ensure clearance between the blade sets associated with respective carriages as one forwardly moving blade set passes by the other rearwardly moving blade set, the lateral extent of the blades is limited by the natural spacing of the operator's feet. Alternatively, the center of effort of each blade is laterally offset from its mounting to the bar 56, although this places additional torsional stress on the blades and their mounting. Alternative blade shapes which permitting a greater lateral span for the blades without incurring such torsional stress are shown in FIGS. 8 and 9.

Figure 10:
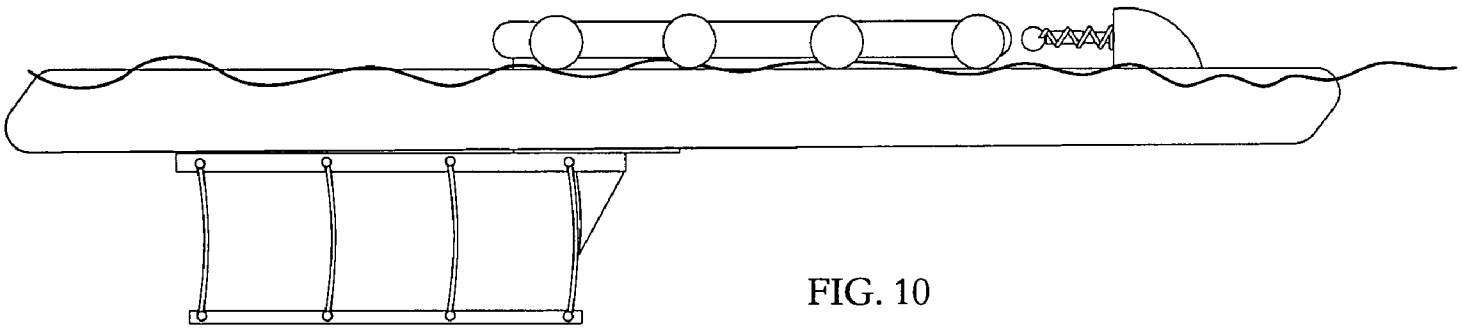
FIG. 10 is a side view of a vehicle according to an embodiment of the invention, the vehicle for conveying a person on water.
Figure 11:
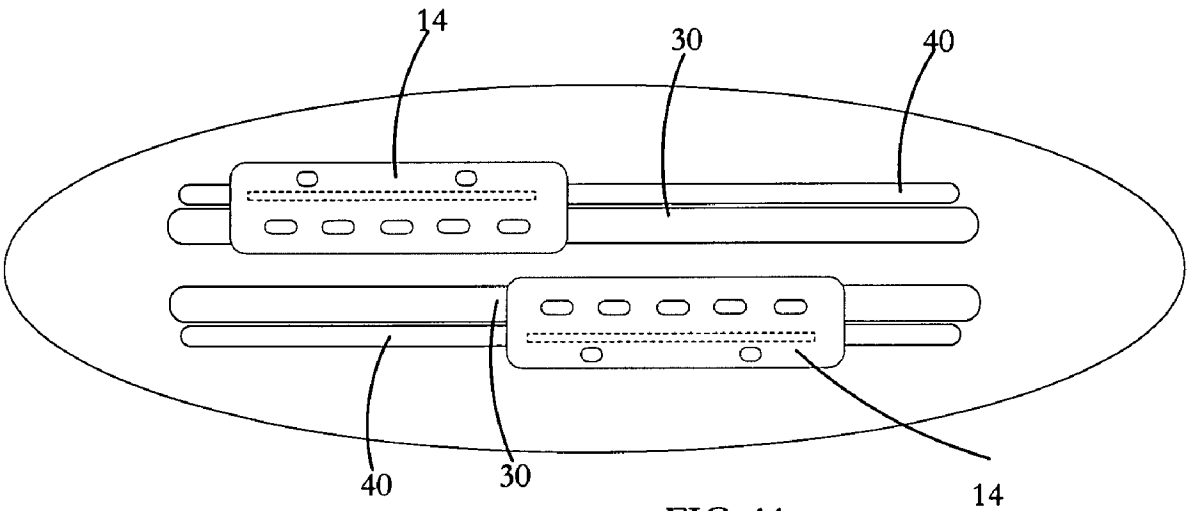
FIG. 11 is a plan view of a vehicle according to an embodiment of the invention, the vehicle for conveying a person on water.
Figure 12:
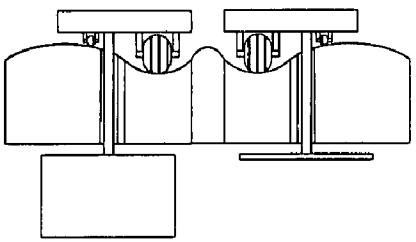
FIG. 12 is a front part-sectional view of the vehicle of FIG. 11.
Figure 13:
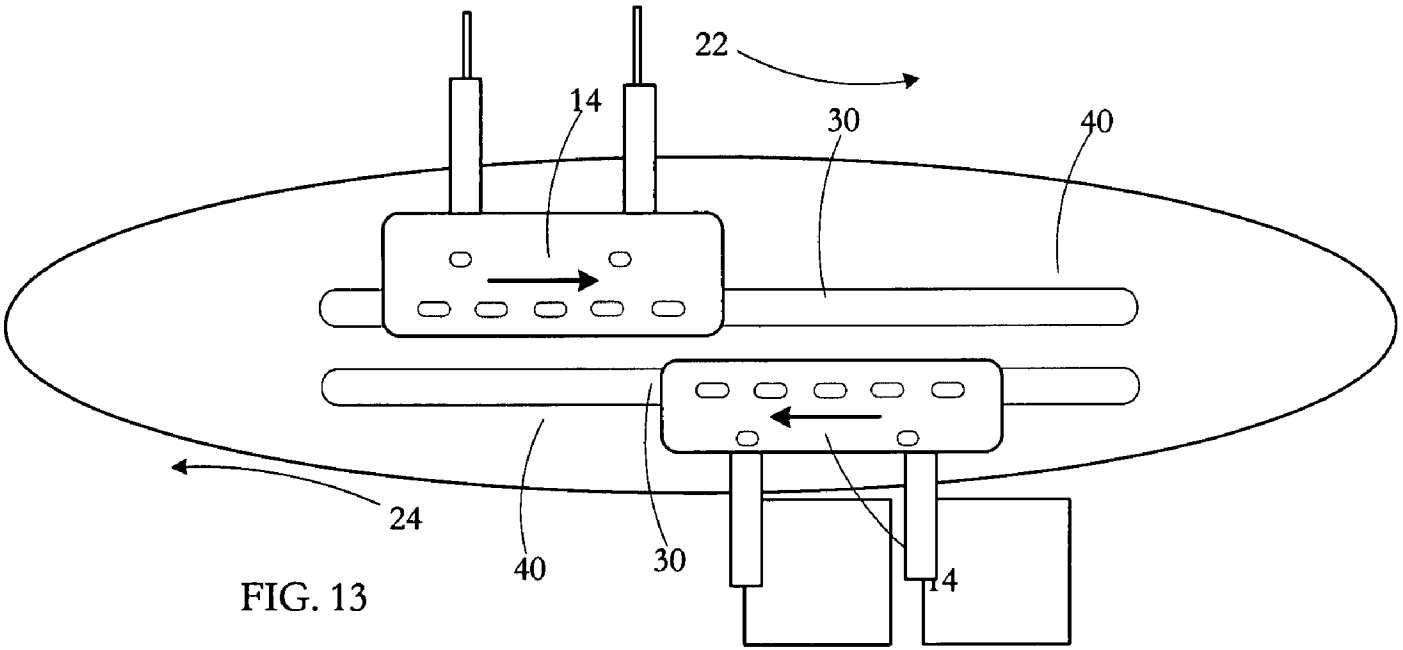
FIG. 13 is a plan view of a vehicle according to an embodiment of the invention, the vehicle for conveying a person on water.
Figure 14:
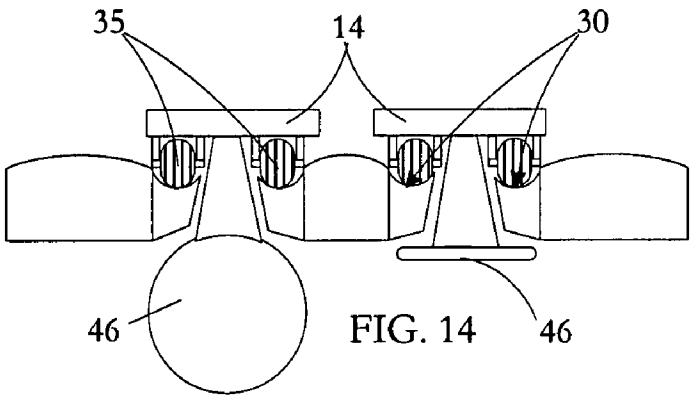
FIG. 14 is a front part-sectional view of a part of a vehicle according to an embodiment of the invention, the vehicle for conveying a person on water.

Although in the embodiment shown in FIGS. 1 to 7, the blades 46 are located generally under the carriage 14, the blade assembly can alternatively be mounted behind the carriage as shown in FIG. 10, or in front. In such an arrangement, the carriage-bearing part of the hull which is subject to high stress from the weight of the operator and the back and forth movement of the carriages is not weakened by being perforated by a slot or similar access for the linkage between the carriage 14 and its associated thrust mechanism 22. However, the assembly of the carriage and thrust mechanism is less compact than that of the arrangement of FIG. 1. In another alternative, as shown in FIGS. 11 and 12, the slot 40 through which the linkage between the carriage 14 and its thrust mechanism passes is located laterally outboard of the track 30. In a further alternative shown in FIG. 13, the thrust mechanism is located totally outboard of the hull. In another alternative shown in FIG. 14, the base under each carriage is open to the water to allow a more direct access of the blades 46 to the water. This facilitates both the mounting and operation of the blades but results in a more complex undercarriage, with each carriage having a left and right set of wheels 35 running in spaced tracks 30.

Figure 15:
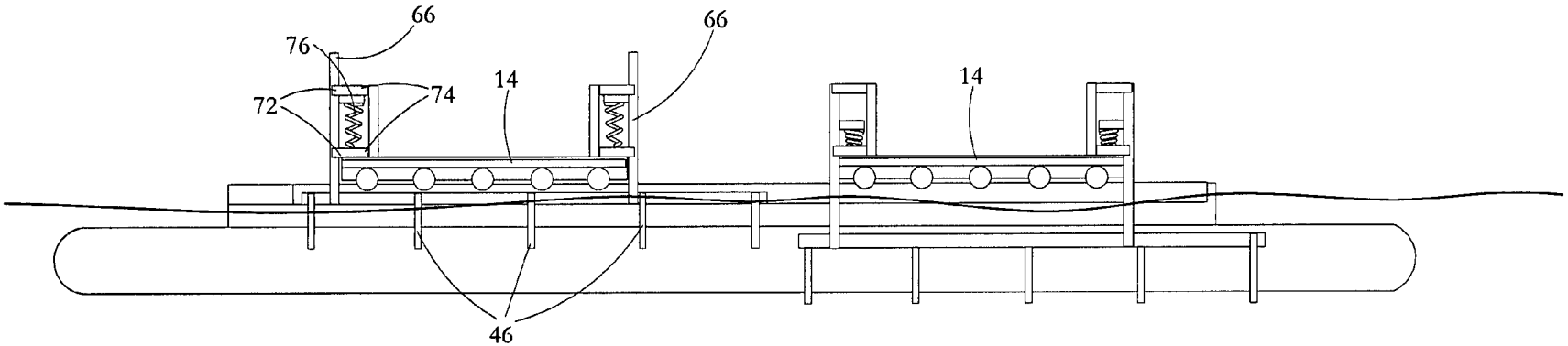
FIG. 15 is a side view of a vehicle according to an embodiment of the invention, the vehicle for conveying a person on water.
Figure 16:
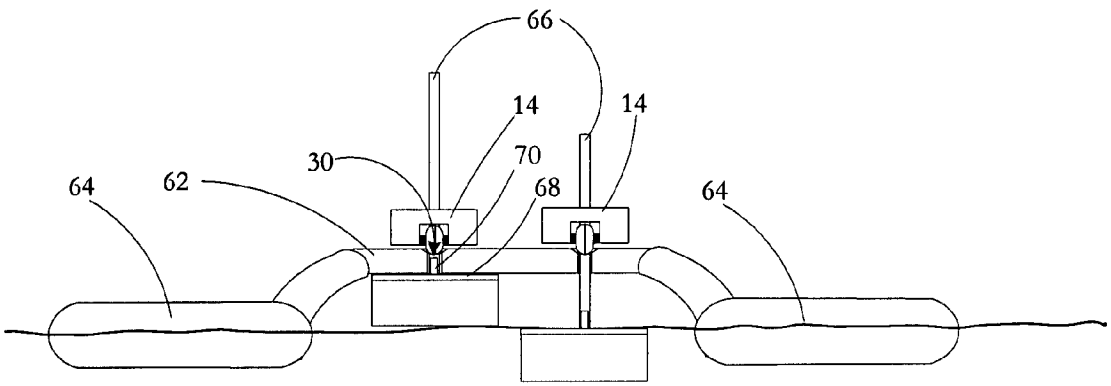
FIG. 16 is a front part-sectional view of a part of the vehicle of FIG. 15

As an alternative thrust mechanism, an arrangement having reciprocable blades is shown in FIGS. 15 and 16. In this arrangement, a raised base part 62 of the hull extends between hull outboard sections 64. Carriages 14 are driven backwards and forwards in tracks 30 in the raised base part by bipedal motion of an operator. At the ends of each carriage 14, an actuator rod 66 is mounted for vertical reciprocal movement and is integral with a flange 68 and integral web 70 extending in a fore and aft direction, the flange and web having a series of blades 46. As shown in FIG. 15, the actuator rods 66 move vertically in guides 72 between positions set by limiters 74 integral with the guides. The rods each have an associated spring 76 and trip mechanism (not shown) the trip mechanisms also including abutments projecting up from the base. In use, during a forward carriage movement, the blades 46 are in a raised, neutral position. At the end of the forward stride, a front one of the trip mechanisms is operated by engagement with a first abutment on the raised base part 62 whereupon the front spring 76, previously cocked, releases to propel the rod 66 from its raised to its lowered position. At the same time, the rear spring 76 is cocked by engagement with a second abutment on the base part. As the rod 66 is lowered, the blades 46 arrayed along the flange 68 and web 70 are also lowered. During a carriage rearward movement, the blades 46 stay in the lowered, deployed position. At the end of the rearward stride, a rear trip mechanism is operated by engagement with a third abutment on the base part whereby the previously cocked rear spring 76 releases to propel the rod 66 from its lowered to its raised position. At the same time, the front spring 76 is cocked by engagement with a fourth abutment on the raised base part 62. As shown in FIGS. 15 and 16, the web 70 associated with the left hand carriage is in a raised position with its blades 46 occupying a position in an air space above the surface of the water but below the lower surface of the base, while the web associated with the right hand carriage is in a lowered position with its blades immersed in the water. The blades 46 are moved alternately between the raised and lowered positions depending on whether the associated carriage 14 is being moved in a forward or rearward direction in relation to the base part 62.

It will be appreciated that other arrangements are possible to obtain the coordinated deployment and feathering of the blades associated with each of the carriages and to maintain the blades in the desired position for the forward and rearward motions. Blades moving between a generally horizontal, neutral position and a generally vertical, deployed position are just one way of achieving thrust. Other suitable forms of thrust element may be used, such as a deformable cup, the cup becoming deformed to a low drag profile by movement in the drive direction through the water and becoming deformed to a high drag profile by movement in the reverse direction through the water. It will also be appreciated that the various elements of the thrust mechanism can be designed and dimensioned to secure the particularly desired effect from the rearward movement of the carriage and, to this extent, such elements act as control mechanisms to set the timing of the thrust and its duration and magnitude in relation to the carriage's rearward movement.

Figure 17:
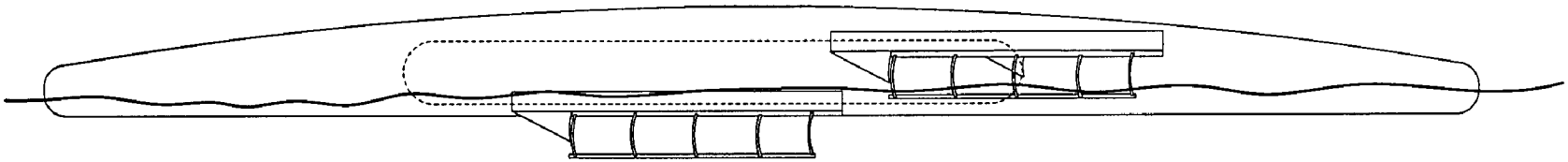
FIG. 17 is a side view of a vehicle according to an embodiment of the invention, the vehicle for conveying a person on water.

A modification of the example of FIGS. 15 and 16 is shown schematically in FIG. 17. The blades 46 are fixed to the carriage 14 and the carriage is mounted to the hull so that the carriage itself is vertically reciprocable within generally rectangular openings through the hull. In operation, as the carriage comes to a halt in its rearward movement, a residual part of its momentum is captured by a suitable transport mechanism and used to lift the carriage from the water together with its set of blades 46 which depend from the bottom of the carriage. The carriage 14 is then moved forward by the bipedal action of the operator until the forward movement ends at which time a corresponding transport mechanism allows the carriage to drop down again relative to the base. This acts to lower the blades 46 into the water before subsequent rearward movement of the carriage is again effected by the operator's bipedal action. The mounting between each carriage and the hull permits coordinated fore and aft and up and down movements as shown by the locus of the carriage centre point (broken line).

In a variation of this arrangement, each carriage has an upper body part which has integral vertically extending blades and a lower undercarriage which is mounted relative to the hull to enable back and forth movement corresponding to bipedal movement of an operator. The body part is mounted on the undercarriage with a mounting that includes a set of springs. The springs are located and dimensioned so that downward operator foot pressure greater than a threshold moves the body part down against the action of the springs and foot pressure less than the threshold permits the carriage to move upwards under the action of the springs. In normal walking and running, the natural movement is to lift the foot from the ground, move it forward and then place it back on the ground at the end of the forward stride, the grounded foot then acting to provide thrust. In the case of the present embodiment, the bipedal action is a scissors action, which may not create the same difference in pressure applied as between one foot and the other. However, operation is effected by the operator so as deliberately to apply greater pressure to the rearwardly moving carriage than the forwardly moving carriage so as to obtain the vertical carriage movement required during the appropriate phase of the reciprocal back and forth movement.

It is desirable to increase the velocity of the vehicle by repeated reciprocation of the left and right carriages in such a way as to generate thrust and to use the thrust to apply the forwardly directed drive to the base and to the vehicle of which the base is part. Any element of the drive mechanism which applies a rearward force to the hull slows the vehicle and is undesirable. In this respect, while the deployment of the blades and their movement through the water is effective in providing thrust when the overall speed of the vehicle is low, this function may become compromised as the speed of the vehicle increases. At a certain threshold velocity of the vehicle, the actual rearward velocity of the blades matches the relative speed of static water moving past the forwardly moving hull. Consequently, if the blade speed through the water simply tracks the vehicle speed through the water, there is little thrust generated as the carriage moves rearwardly in the water. At hull speeds in excess of the threshold, the deployed blades simply create drag and reduce hull speed. To overcome this problem, the thrust mechanism includes an accelerator mechanism to accelerate the rearwardly moving blades to a velocity higher than the velocity reached by the rearwardly moving carriage. This causes the blades to move in a shortened cycle in a reverse direction through the water at a speed greater than the hull forward speed through the water. The cycle time for reverse movement of the carriage is achieved in one example, by having a flexible mounting between a body part of the carriage and an undercarriage. In operation, in a first part of a stride during operator bipedal movement, the body part but not the undercarriage is moved rearwardly with the initial movement of the body part being used to store energy in a spring mechanism. At a desired point in the cycle, the energy in the spring mechanism is released and applied to drive the undercarriage and its associated blades rearwardly at a speed greater than the speed of the carriage.

Although the examples of vehicle shown in the previous FIGS. are adapted to be operated by a single operator, another embodiment of the invention has a larger hull and stations for several people. In such an embodiment, the carriages can be independently operated with, for example, the carriages at one station located behind the carriages of another station. In multi-station arrangements, the drive mechanisms at the stations provide linkages between the respective carriages and the base and the thrust mechanisms provide linkages between the respective carriages and the water. Alternatively, operating elements at adjacent stations can be shared or ganged.

It will be appreciated that the bipedal action of different people is different. For example, one person may have a much longer stride or may be able to apply a much greater thrust and drive than another person. Or one person may have feet which are smaller or set closer together when standing than another person. In one alternative embodiment of the invention, the arrangements described previously are made adjustable so that at least some of the dimensions and specifications can be changed to fit the operator. For example, different sizes or different numbers of blades can be attached to a carriage. Or the extent of immersion of the blades in the water in a deployed position can be varied. The base and hull can be made narrow for operators having good balance and a focus on speed or can be made relatively wide if speed is less important than stability. Such adjustment schemes can be made adaptive so that, for example, in changing from a walking stride to a running stride, systems are triggered by sensed changes in the operator's interaction with the carriage, with such systems then adapting operating characteristics to the walking to running change.

In another alternative embodiment of the invention, the structural elements described previously are in modular form. In one such embodiment, a relatively bare hull or other base is adapted by, for example, having openings and fixtures tailored to have mounted thereon a personalized carriage set combined with elements of associated thrust and drive mechanisms. In another such embodiment, the thrust and drive mechanisms are already mounted on the hull and the operator installs his or her carriage set, with the carriage set being fastened to the elements of the thrust and drive mechanisms. In a further such embodiment, a boot or similar footwear is attached to each carriage of a carriage set adapted to be mounted on a base.

In normal walking or running, a subsidiary but important part of the body's articulation is arm movement. This can provide added thrust to the walking or running action. The power of arm movements has been used by cross-country skiers through the agency of ski poles. In a modification of the invention, an adjunct mechanism includes an element held by the operator or attached to the operator's arm. The adjunct mechanism is used to harness the swinging movement of the operator's arms which is a natural concomitant to the leg movements of walking and running. The harnessed arm movement is used to apply a supplementary force through the thrust mechanism to increase the cumulative force applied in a rearward direction to the water thereby developing greater thrust, and/or to apply a supplementary force through the drive mechanism to increase the cumulative drive applied in a forward direction to the vehicular part.

Figure 18:
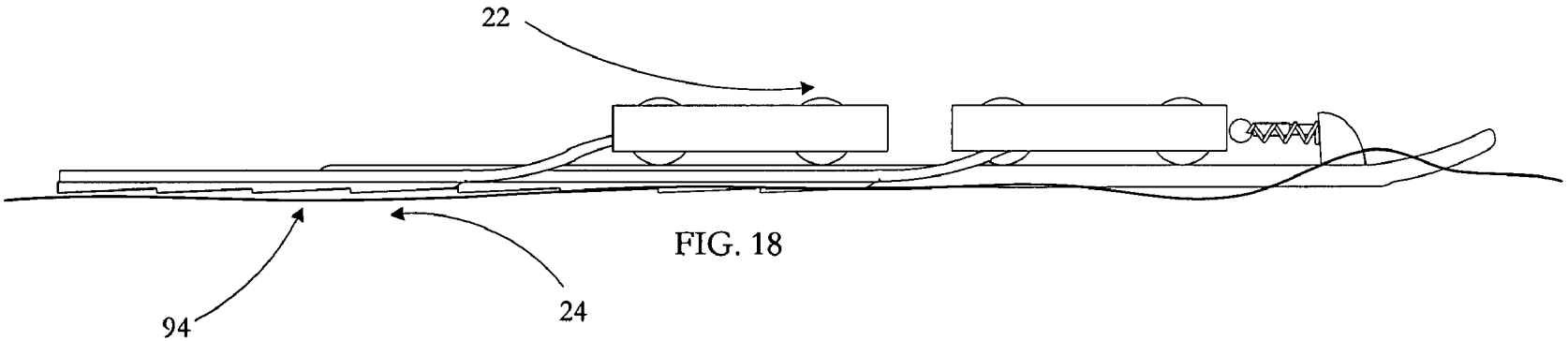
FIG. 18 is a side view of a vehicle according to an embodiment of the invention, the vehicle for conveying a person on snow or ice.
Figure 19:
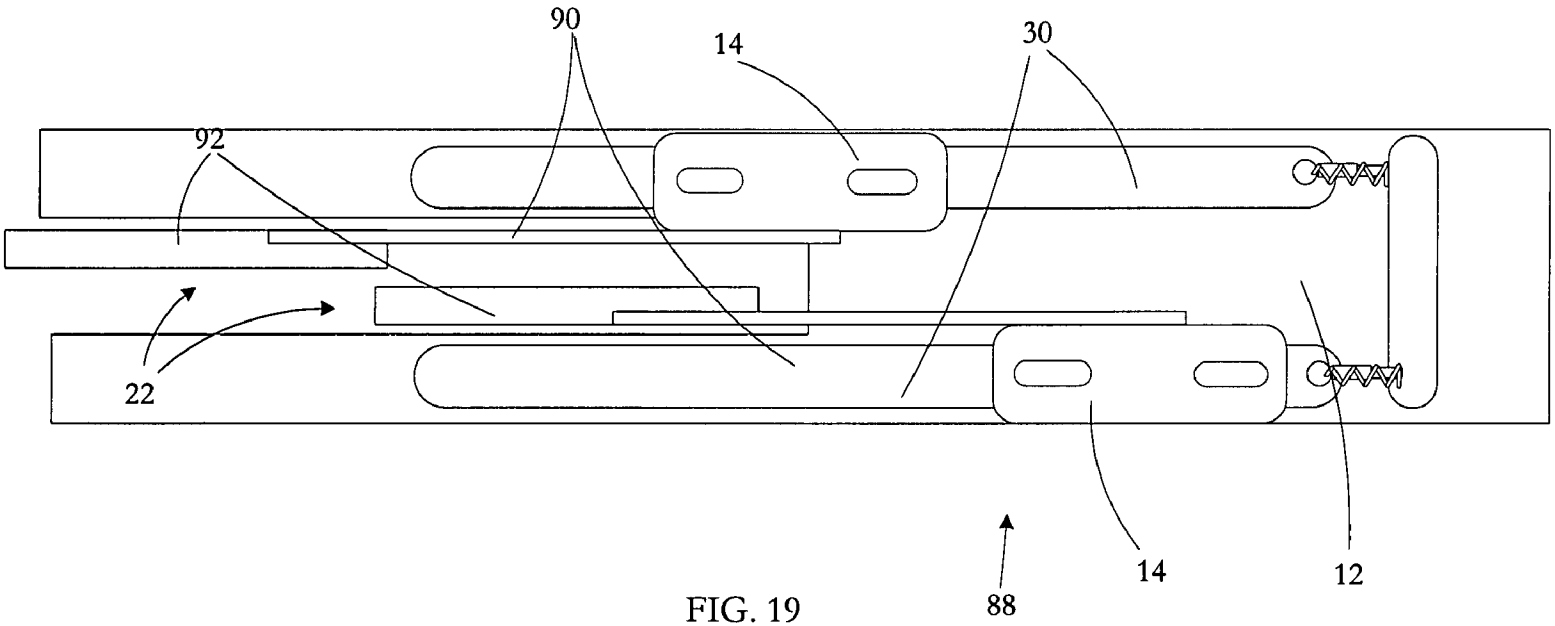
FIG. 19 is a plan view of the vehicle of FIG. 18.

While the invention has been described in relation to a vehicle moving relative to water, the invention also lends itself to movement over a solid surface such as the ground or ice or snow. In the arrangement shown in FIGS. 18 and 19, an ice or snow vehicle is shown. As in the prior water vehicles, carriages 14 are mounted for reciprocation on a base 12 but, in this case, the base is mounted on or forms an integral part of a sled 88. As in the prior water embodiments, the sled includes a thrust mechanism by means of which thrust is developed by the operator applying, through bipedal movement, a rearwardly directed force to the ice or snow via the rearwardly moving carriage. In addition, a drive mechanism is used by means of which the operator through bipedal movement applies a forwardly directed drive via the carriage to the sled. As shown in FIGS. 18 and 19, each thrust mechanism includes a leg 90 associated with each carriage, the leg having an extension 92 formed with a serrated or scaled lower surface 94 similar to that often formed on a cross-country ski. The leg 90 is formed of spring material so that the extension 92 is biased to create a contact pressure at the interface of the scaled surface and the ice or snow. Similarly to a cross-country ski, the extension rides easily over the snow upon forward bipedally driven movement of the associated carriage. Upon reverse movement of the carriage, the spring bias coupled with the scaled surface acts to develop thrust which is transmitted back through the extension and the leg to the carriage. The thrust is converted into drive applied to the sled either through an arrangement such as the spring an abutment shown in FIGS. 19 and 20, or through a unidirectional wheel resistance method as described previously, or through other suitable means.

Figure 20:
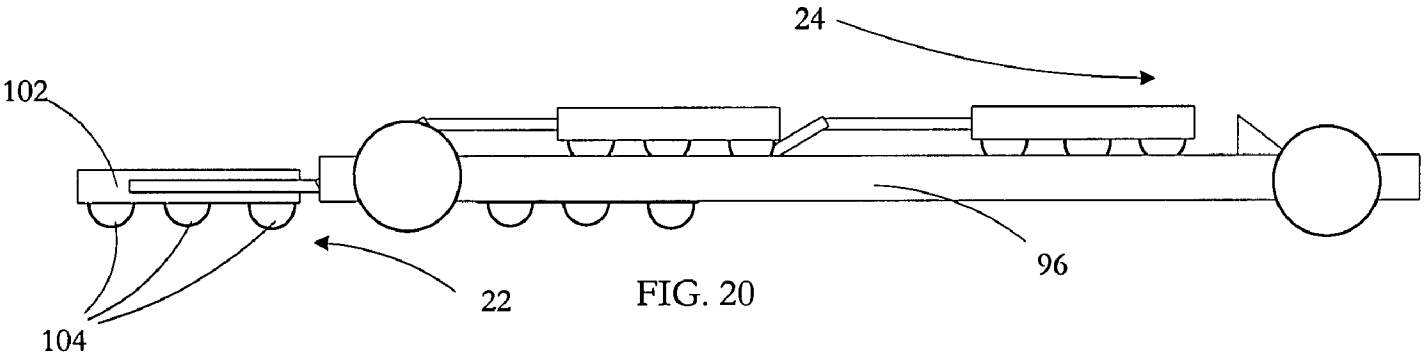
FIG. 20 is a side view of a vehicle according to an embodiment of the invention, the vehicle for conveying a person along the ground.
Figure 21:
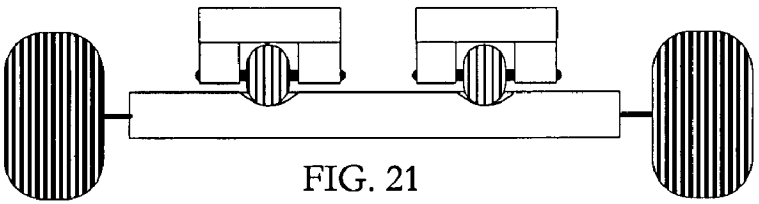
FIG. 21 is a front part-sectional view of a part of the vehicle of FIG. 20.
Figure 22:
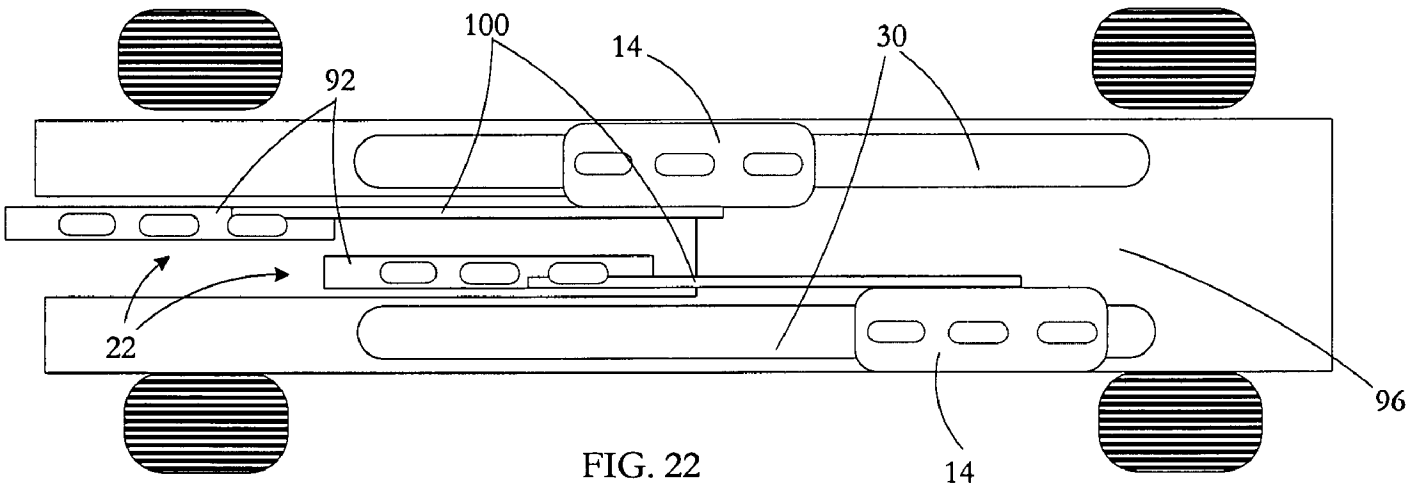
FIG. 22 is a plan view of the vehicle of FIG. 20.

FIGS. 20 to 22 are views of a wheeled vehicle embodiment of the invention. The carriages 14 are mounted for reciprocation on a vehicle chassis 96 which is mounted on wheels 98. The vehicle includes thrust mechanism 22 to develop thrust by applying a rearwardly directed force via the rearwardly moving carriage 14 to the ground, and drive mechanism 24 by means of which the operator applies a forwardly directed drive via the carriage 14 to the chassis. The thrust mechanism 22 includes a leg 100 associated with each carriage, the leg being attached to a drive carriage 102 having several in-line wheels 104 each having a bearing characterized by offering minimal resistance to forward movement of the associated carriage 14 but being resistant to the wheels 104 being driven to turn by reverse movement of the carriage 14. The leg 100 is a leaf spring configured and mounted so that the wheels 104 are biased to create a contact pressure at the interface of the wheels with the ground. With this type of bearing, the drive carriage 102 rolls easily over the ground during forward bipedally driven movement of the associated carriage 14 to which the drive carriage is fixed. Upon reverse movement of the carriage 14, the spring bias coupled with the turning resistant bearings of the wheels 104 act to develop thrust which is transmitted back through the drive carriage 102 and the leg 100 to the carriage 14. The thrust is converted into drive applied to the chassis 96 either through an arrangement such as the spring and abutment shown in FIGS. 18 and 19, or through a unidirectional wheel resistance method as previously described, or through any other suitable means as may be adapted for working with the wheeled chassis as opposed to a hull.

Both the ice/snow based and the ground based embodiments of the invention are illustrated by examples in which the thrust mechanism trails the associated carriage 14. It will be appreciated that the thrust mechanism can be located underneath the associated carriage as in the example of FIGS. 1 and 2, or can lead the carriage 14.

In a further alternative embodiment of the invention, the carriage is mounted adjacent a damped, driven hammer oscillator which is itself mounted on the base. The oscillator has a spring system and a hammer member mounted relative to the spring system for reciprocal motion in the drive and reverse direction and in an oscillatory mode. The oscillator has a drive interaction with each carriage in which a force is applied to the hammer member by transferring some of the momentum from the carriage as it is driven back and forth by the operator's bipedal movement. The oscillator has a damping interaction with the thrust and/or drive mechanism in which a force is applied from the hammer member to the thrust and/or drive mechanism by the hammer member as it oscillates back and forth. As a result of this damping interaction, energy in the oscillator is tapped in the course of the operation of the thrust and drive mechanisms but results in a damping of the oscillation. The drive force acts to compensate for the damping whereby substantially to maintain the oscillator's harmonic oscillation. The weight and mounting of the hammer member is tailored to the particular oscillation which it is desired to set up, this being dependent on the capabilities of the vehicle operator. As the operator walks or runs in the bipedal movement previously defined, the coupling of the hammer member with the carriage, drive and thrust systems is such as to set up and maintain a substantially harmonic oscillation in the movement of the hammer member relative to the base. In a further variation of this embodiment particularly applicable to the example of FIG. 17, some of the energy in the oscillating hammer member is used to raise the carriage so as to move the blades between the neutral and deployed positions depending on the instant fore-aft position of the carriage.

Figure 23:
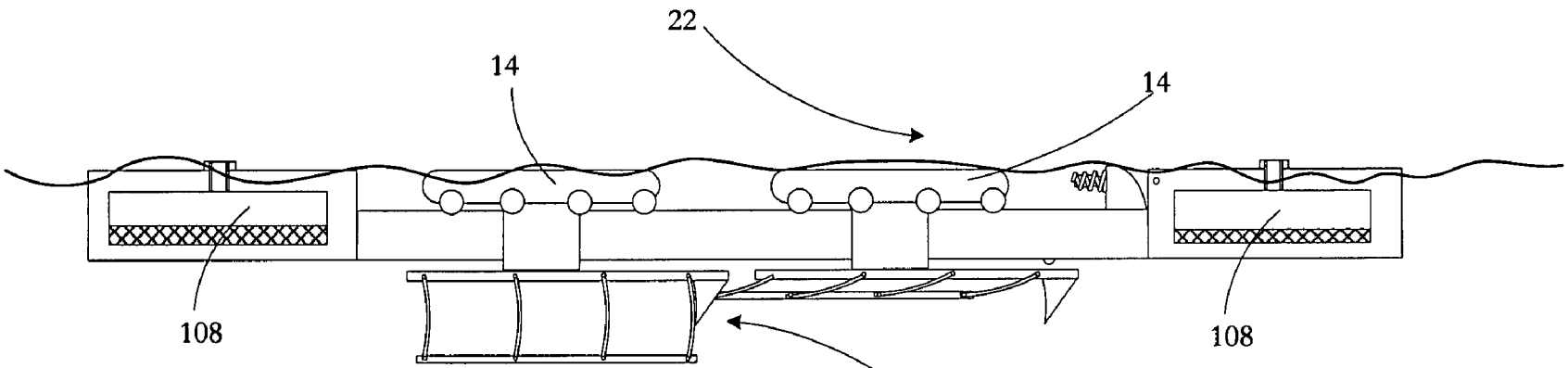
FIG. 23 is a side view of a vehicle according to an embodiment of the invention, the vehicle for use in presenting the spectacle of a person walking on water.

Referring to FIG. 23, there is shown a vehicle particularly adapted for presenting the desirable spectacle of walking on water. The vehicle includes a trim mechanism comprising for and aft chambers 108 in the hull which contain a certain proportion of air to water and where the proportion of air to water can be adjusted using a pump before setting out on a voyage. In use, an operator knows his or her own weight, the weight of the unloaded vehicle, and the vehicle hull displacement when underwater. By appropriately adjusting the air to water ratio in the chamber, the operator can configure the vehicle and operator weight so as essentially to submerse the complete vehicle apart perhaps from the top part of the carriages 14. To achieve this effect, some part of the reciprocating carriages is under water which detracts from the efficiency of movement when the carriages are moved back and forth by the operator's bipedal movement. Also, the hull shape may not be optimally efficient. However, it looks really good.

Figure 24:
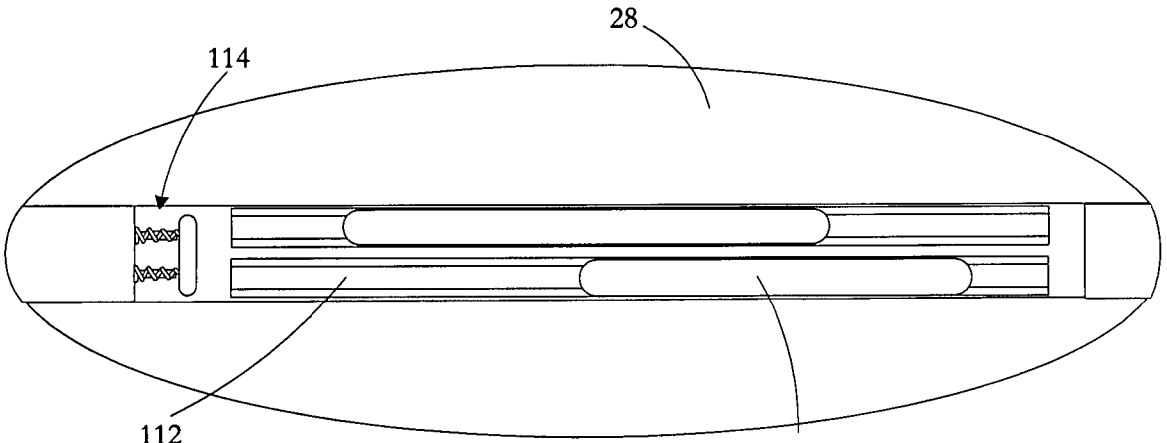
FIG. 24 is a plan view of a vehicle according to an embodiment of the invention, the vehicle for conveying a person on water.
Figure 25:
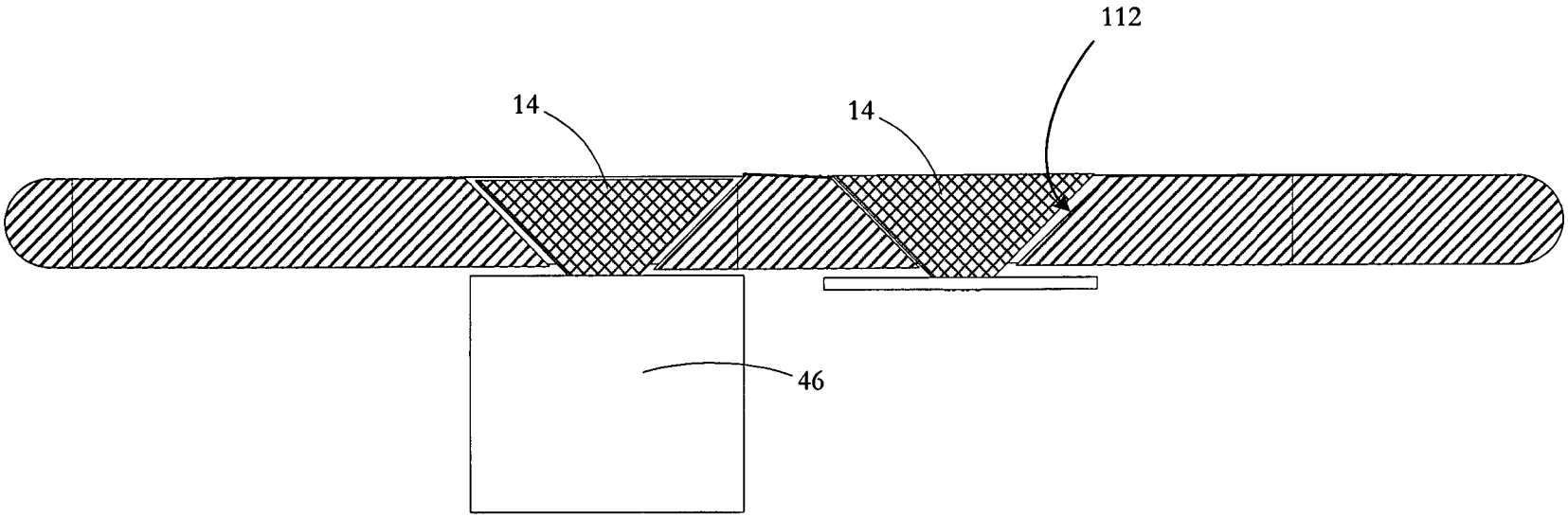
FIG. 25 is a cross-sectional view of the vehicle of FIG. 24.

Referring to FIG. 24, there is shown a vehicle having carriages 14 of more simple form in comparison with the wheeled carriages illustrated in previous embodiments. In this embodiment of the invention, which is adapted for use on water, hull 28 has two openings 110 extending over a large part of its length. As shown in FIG. 25 to a larger scale, walls of the openings slope inwardly towards the lower part of the hull so as to present a V-shaped bearing surface 112. Carriages 14 are formed with a matched V-shaped profile, so that with the operator standing with one foot on each carriage, the V-shaped carriages seat against the respective V-shaped elongate opening 110. The bearing surfaces of each of the carriage and the hull surface are formed of materials which present low friction so as to facilitate a back and forth sliding movement of the carriages within the elongate openings, the friction being further reduced by the presence of the water through which the vehicle is moving and which acts to lubricate the bearing surfaces. An abutment and spring arrangement 114 is mounted near the bow of the full so as to intercept the forwardly sliding carriages as they reach the end of their forward movement when driven by the operator's bipedal motion. This acts to transfer the operator's forward momentum to the hull at each forward stride. In transferring drive to the hull from the forwardly moving carriages, alternatives to the spring and abutment arrangement 114 may be used, such as those previously described in relation to other illustrated examples of the invention. In terms of developing thrust, an arrangement similar to any suitable one of those described previously may be adopted. In this illustration, one of the carriages is shown with a blade 46 in the deployed position while the other carriage is shown with its blade in the neutral position but, for ease of reference, actuating mechanisms for moving the blades between neutral and deployed positions are not shown.

It will be appreciated that many other variations are possible within the inventive concepts disclosed herein and it is not intended that the scope of the patent should be limited to the specific embodiments described.

What is claimed is:

1. A vehicle for movement relative to a medium, the vehicle comprising a base, and two carriages mounted side by side relative to the base for supporting respective feet of a human operator, the carriages mounted for forward and rearward movement relative to the base upon being driven by bipedal movement of the operator, a thrust mechanism operable to develop vehicle thrust by transmitting a force to the medium upon bipedally driven rearward movement of the carriages, and a drive mechanism operable to apply a drive to the base upon bipedally driven forward movement of the carriages, the thrust mechanism including at least one element movable between a deployed position, enabling application of force from a respective one of the carriages to the medium on said rearward movement of said carriage, and a neutral position, disabling application of force from said carriage to the medium, the at least one element presenting in the deployed position a high friction contact with the medium and presenting in the neutral position a low friction contact with the medium.

2. A vehicle for movement relative to a medium, the vehicle comprising a base, and two carriages mounted side by side relative to the base for supporting respective feet of a human operator, the carriages mounted for forward and rearward movement relative to the base upon being driven by bipedal movement of the operator, a thrust mechanism operable to develop vehicle thrust by transmitting a force to the medium upon bipedally driven rearward movement of the carriages, and a drive mechanism operable to apply a drive to the base upon bipedally driven forward movement of the carriages, the base forming part of a wheeled chassis.

3. A vehicle for movement relative to a medium, the vehicle comprising a base, and two carriages mounted side by side relative to the base for supporting respective feet of a human operator, the carriages mounted for forward and rearward movement relative to the base upon being driven by bipedal movement of the operator, a thrust mechanism operable to develop vehicle thrust by transmitting a force to the medium upon bipedally driven rearward movement of the carriages, and a drive mechanism operable to apply a drive to the base upon bipedally driven forward movement of the carriages, the base forming part of a sled.

4. A vehicle for movement relative to a medium, the vehicle comprising a base, and two carriages mounted side by side relative to the base for supporting respective feet of a human operator, the carriages mounted for forward and rearward movement relative to the base upon being driven by bipedal movement of the operator, a thrust mechanism operable to develop vehicle thrust by transmitting a force to the medium upon bipedally driven rearward movement of the carriages, and a drive mechanism operable to apply a drive to the base upon bipedally driven forward movement of the carriages, the thrust mechanism including at least one element movable between a deployed position, enabling application of force from a respective one of the carriages to the medium on said rearward movement of said carriage, and a neutral position, disabling application of force from said carriage to the medium, the at least one element being integral with said carriage, and a transport mechanism engaging said carriage at limiting positions of the forward and rearward movement, respectively to lower and lift said carriage.

5. A vehicle for movement relative to a medium, the vehicle comprising a base, and two carriages mounted side by side relative to the base for supporting respective feet of a human operator, the carriages mounted for forward and rearward movement relative to the base upon being driven by bipedal movement of the operator, a thrust mechanism operable to develop vehicle thrust by transmitting a force to the medium upon bipedally driven rearward movement of the carriages, a drive mechanism operable to apply a drive to the base upon bipedally driven forward movement of the carriages, and a driven, damped harmonic oscillator operable to tap energy from movement of the carriages and to transfer energy to at least one of the thrust mechanism and the drive mechanism.

6. A vehicle for movement relative to a medium, the vehicle comprising a base, and two carriages mounted side by side relative to the base for supporting respective feet of a human operator, the carriages mounted for forward and rearward movement relative to the base upon being driven by bipedal movement of the operator, a thrust mechanism operable to develop vehicle thrust by transmitting a force to the medium upon bipedally driven rearward movement of the carriages, and a drive mechanism operable to apply a drive to the base upon bipedally driven forward movement of the carriages, each carriage having a bearing for mounting the carriage relative to the base to enable the forward and rearward movement of the carriage relative to the base, the bearing having a free bearing action in relation to the carriage moving relative to the vehicle base in the forward direction and having a non-free bearing action in relation to the carriage moving relative to the vehicle base in the rearward direction.

* * * * *